United States Patent [19]

Sahakian et al.

[11] Patent Number: 4,511,769

[45] Date of Patent: Apr. 16, 1985

[54] MULTI-PATH INTERRUPTER DEVICE

[75] Inventors: Diran R. Sahakian, Noisy le Sec; Lucien Pellerin, Septeuil; Sjoerd Nijboer, Carrieres, all of France

[73] Assignee: U.S. Philips Corporation, New York, N.Y.

[21] Appl. No.: 522,073

[22] Filed: Aug. 11, 1983

[30] Foreign Application Priority Data

Aug. 20, 1982 [FR] France ..... 82 14400

[51] Int. Cl.[3] ..... H01H 13/70; H01H 25/00

[52] U.S. Cl. ..... 200/6 A; 200/153 K; 200/264

[58] Field of Search ..... 200/5 R, 5 A, 6 A, 17 R, 200/264, 153 K, 292, 18

[56] References Cited

U.S. PATENT DOCUMENTS 4,132,873 1/1979 Vanderpoel ..... 200/264 X
4,297,542 10/1981 Shumwag ..... 200/5 A
4,349,708 9/1982 Asher ..... 200/6 A
4,394,548 7/1983 Dola ..... 200/6 A
4,408,103 10/1983 Smith ..... 200/17 R X

*Primary Examiner*—J. R. Scott
*Attorney, Agent, or Firm*—Joseph P. Abate

[57] ABSTRACT

A multi-path interrupter device (e.g. a joystick) includes a housing 10 constituted by two parts (11, 12), a plurality of interrupters 16 distributed along a circle, and a control member 20. The control member is formed of a single piece of resilient material and has a lever pin 21 held on a pivot 25 carried by the housing. The control member 20 includes a peripheral crown 23 arranged to act on the interrupters 16. The member 20 also includes resilient return means for biasing the member to a central rest position.

The return means includes tongues 30 cut radially out of the control member 20, the flexible end of these tongues bearing on the lateral surface of a truncated cone 28 carried by the part 12 of the housing, which cone 28 forms an opening for passing the pin 21.

2 Claims, 5 Drawing Figures

MULTI-PATH INTERRUPTER DEVICE

BACKGROUND OF THE INVENTION

The invention relates to an improvement of a multi-path interrupter device, comprising a housing which is constituted by two assembled parts and accommodates a plurality of contact means for acting as an interrupter, distributed along a circle and joined to a part of the housing, and a manual control member comprising in a single piece made of resilient material:

a control lever, whose pin emerges from the housing through an opening of its upper part, while the other end of the lever is supported by a central pivot carried by the lower part of the housing, which control lever can be inclined in different directions from a central rest position, resilient return means in the form of parts intergrally formed with the control member which parts are elastically deformable and are arranged so that they bear on abutment means carried by the housing, the return means biasing the control lever to the central rest position, and a peripheral crown arranged so that the crown acts on at least one of the contact means when the control lever is manually inclined.

Such a device is known from European Pat. No. 0024813 (corresponding to U.S. Pat. No. 4,349,708) for use as a manual controller associated with an electronic video game, by which controller the user gives orders to the electronic game, for example, for displacing objects or images of persons displayed on a cathode screen. In the known device, the control member can be displaced in eight different directions from a central position which is at right angles to the major surface of the housing. When this member is pushed in one of these directions, a peripheral crown forming part of the same control member is tilted so that a point of the periphery exerts a pressure on one of the four electrical interrupters arranged along a concentric circle having the same diameter as the peripheral crown.

The resilient return means of the control member, for biasing the control member to the central rest position, is constituted in part by the peripheral crown itself, which is made deformable by arcuate recesses, only four points of connection of the peripheral crown to the control member being left. For another part the resilient return means are further constituted by a supplementary piece in the form of a glove finger which is wound onto the pin of the control lever and is connected to the housing by a deformable bellow, this piece being made of a flexible elastomer.

The known device has the disadvantage that an angle of inclination of the control lever as large as is desired in practice cannot be obtained and that a comparatively large force is required to actuate it. This is especially due to the fact that the major part of the return forces is supplied by the deformable peripheral crown which also ensures that the pressure is exerted on the interrupters and is not or substantially not capable of independently controlling these two forces (the return force and pressure force on the interrupters).

Otherwise, the known device utilizes four interrupters, which permits of obtaining a control in eight directions, because two consecutive interrupters can also be actuated simultaneously. According to given applications, it may be desirable to increase the number of interrupters, which, in view of the construction of the known device, may lead to insurmountable difficulties.

SUMMARY OF THE INVENTION

The present invention has for its object to provide a device in which these disadvantages are avoided.

The invention further has for its object to provide a device whose structure is so simplified that it can be manufactured easily and economically.

For this purpose, according to the invention, a multi-path interrupter device, of the kind defined in the preamble, is characterized in that the parts of the control member constituting the resilient return means are constituted by a plurality of tongues radially cut out of a part of the control member in the form of a disc which connects the control lever to the peripheral crown, the flexible end of said tongues facing the center of sid disc-shaped part, in that the opening of the upper part of the housing comprises a truncated cone which extends to the interior of the housing and whose axis substantially coincides with the axis of the central pivot, which truncated cone constitutes said abutment means by its lateral outer surface by which the said tongues are supported.

The device according to the invention has the advantage that the return force of the control member can be determined due to its construction quite independently of the control of the pressure on the contact means. This pressure itself depends upon the deformation of the disc-shaped part of the control member and more particularly of its peripheral crown. Otherwise, said peripheral crown can act through any arbitrary point of its periphery so that the number of interrupters can be varied at will without the necessity of controlling again the pressure and return forces in the rest position.

Further, the device according to the invention is particularly suitable in that the control lever can be inclined through a large angle (25° or 30° from the central position). Of course, if desired, a small angle of inclination may also be chosen without any objection.

The control member is preferably molded from a material having resilient properties, such as a polyoxymethylene, a homopolymer or a copolymer, or an aromatic polyamide.

Due to their radial disposition and their flexible ends arranged on a circle having a diameter considerably smaller than that of the peripheral crown, the tongues produce the return force of the control member in the central position under the influence of a flexion whose amplitude remains small. One or the other of the polymeric materials having resilient properties, especially those mentioned above, are capable of withstanding, without fatigue, such deformations so that the control member can perform an extremely large number of operations without breaking down. Further, by following simple geometric rules, the displacement of the flexible end of the tongues bearing on the lateral surface of the truncated cone during the flexion inherent to the operation can be readily reduced to a minimum so that the amount of wear due to the friction is negligible and the operation is noiseless.

Any known interrupter actuated by pressure may be utilized as a contact means.

An embodiment of the device according to the invention is characterized in that, one of the parts of the housing being made of an insulating material and carrying on its inner surface an assembly of conductor tracks insulated from each other, the control member has on its peripheral crown an associated ring of a conductive elastomer intended to establish by pressure at the points provided for the contacts an electrical connection between at least two of the conductor tracks.

According to this embodiment, the device is composed of a minimum number of separate elements so that it is particularly economical.

BRIEF DESCRIPTION OF THE DRAWING

In order that the invention may be readily carried out, it will now be described more fully with reference to the accompanying drawings, in which.

DESCRIPTION OF THE PREFERRED EMBODIMENTS

Figure 1A:
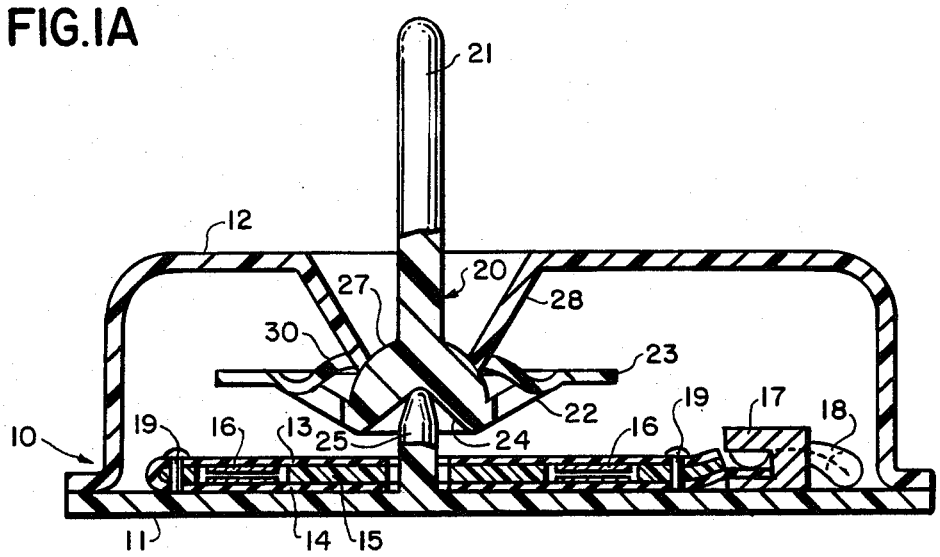
FIGS. 1A and 1B are sectional views of a device according to the invention, the control member being in the rest position and in the working position, respectively.
Figure 1B:
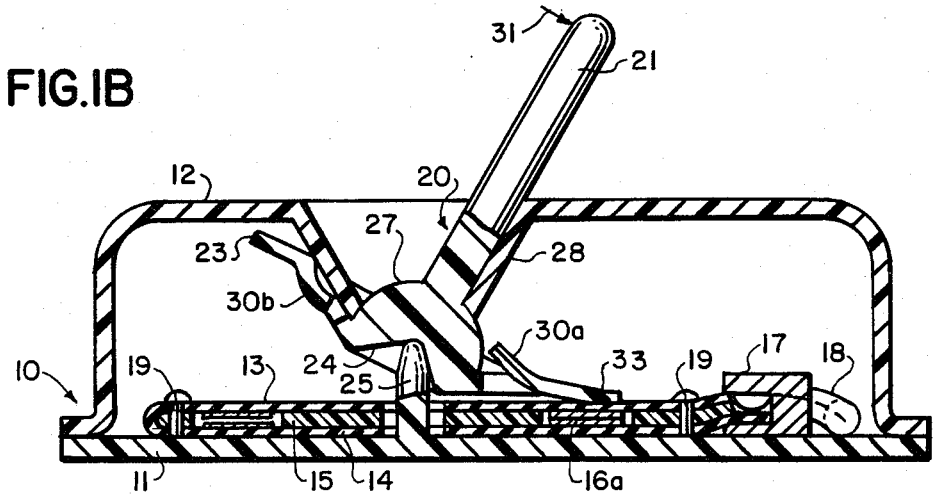

FIGS. 1A and 1B show in sectional view the same interrupter device. It is composed of a housing 10 constituted by the assembly of a lower part 11 and an upper part 12. The housing 10 accommodates a plurality of contact means for acting as an interrupter. In the embodiment shown, the plurality of contact means is constituted by two folded parts 13, 14 of a flexible film of an insulating material, which carry conductor tracks and by an interposed film 15 having openings at the points provided for the contacts. For the sake of clarity, only the active points of the contacts 16 are shown in FIGS. 1A and 1B. According to a technique known per se, by pressure on the part 13 of the flexible film, starting from the points provided for the contacts 16, which are distributed along a circle, the closure of the electric circuit constituted by one of the conductor tracks carried by the part 14 and a common conductor track carried by the part 13 of the flexible film is determined. The conductor tracks extend to one end of the film at which a connector 17 establishes the electrical connection with the conductors of the cable 18 by means of which the device can be connected to the apparatus (not shown) for which the system constitutes a multi-directional controller. The assembly of the electrical contact means is joined to the lower part 11 of the housing by means of, for example, positioning pins 19.

The device further comprises a control member 20 consisting of a single part made of a resilient material. This member is preferably obtained by molding of a polyoxymethylene or an aromatic polyamide. The control member comprises a pin 21 constituting a handling lever and a widened part in the form of a disc terminating in a peripheral crown 23 of circular form. The control member 20 can be tilted in all directions from a central rest position, FIG. 1A representing said member in its rest position, while in FIG. 1B the member 20 is shown in the position in which the pin 21 of the lever is inclined to the right and produces a contact at the point 16*a*. In order to permit the control member 20 of being inclined in different directions, it comprises, at the center of its lower part, a cavity 24 of substantially conical form, in which is engaged a support finger 25 forming a central pivot carried by the lower part 11 of the housing.

Besides by the resilient return means, which will be described hereinafter and which contributes to pushing the member 20 so as to bear on the finger 25, the movement of said member is also maintained due to the fact that at the base of the pin 21, it has a widened part 27 of spherical form which projects beyond the cavity 24. The upper part 12 of the housing in turn comprises an opening in the form of a truncated cone 28 which permits the passage of the pin 21 and extends to the interior of the housing, the axis of this opening substantially coinciding with the axis of the central pivot. Although it is generally preferred to provide a small amount of mechanical clearance between the end of the truncated cone 28 and the spherical widened part 27 (in order to avoid undesirable frictions), any movement of the member 20, if it would be pivoted to the exterior of the housing, is limited by the abutment of the spherical widened part 27 against the end of the truncated cone 28.

Figure 2:
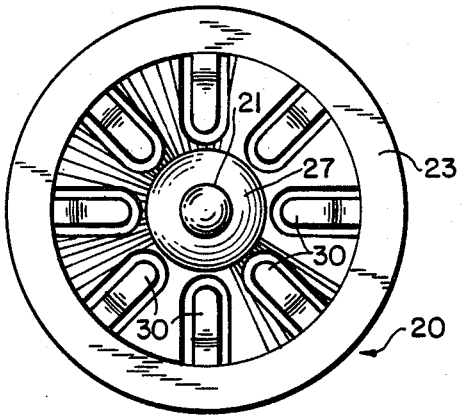
FIG. 2 is a plan view of the control member of the device shown in FIG. 1.

FIG. 2 shows the control member 20 of the device of FIG. 1 in plan view. With reference to this Figure and in connection with FIGS. 1A and 1B, the resilient return means of the control member, for biasing the control member 20 to its central rest position, can be described. For this purpose, the member 20 comprises a plurality of tongues 30 cut radially out of the disc-shaped part 22 which connects the control lever to the peripheral crown 23.

According to the embodiment shown in FIGS. 1A, 1B and 2, the tongues 30 have an end joined to the control member 20 near the peripheral crown 23.

According to another embodiment, not shown, the tongues cut out are arranged in a disposition in the form of an M so that the end joined to the control member is subdivided into two lateral tongue portions fixed to the control member 20 near the spherical widened part 27.

The other end of the tongues 30 is free and flexible. In all cases it is arranged so that it will bear on the lateral outer surface of the truncated cone 28 forming the opening of the housing. In the rest position of the control member 20 (as shown in FIG. 1A), all the tongues 30 bear on the truncated cone 28. Actually, this is not absolutely necessary and, if this would not be the case, the central rest position of the member 20 would only be defined less accurately. In the preferred embodiment, in which the tongues are supported, said tongues are slightly deformed so that they each exert in a substantially equal manner a very moderate pressure force on the outer surface of the truncated cone 28, which force holds the member 20 in its rest position and further ensures that it bears on the finger 25.

It appears from FIG. 1B that certain tongues, such as 30*a*, are located at a certain distance from the truncated cone 28, whereas other tongues, such as 30*b*, are strongly deformed in response to a pivotal movement of the pin 21, as shown in the Figure by an arrow 31. The deformation of the tongues 30*b* produces a restoring torque of the member 20, which assumes its rest position as soon as the pivotal movement is stopped.

In the position of the member 20 shown in FIG. 1B, which is designated as the working position, a zone 33 of the peripheral crown 23 exerts a pressure on the contact point 16*a*. Since under the influence of this pressure the depression of the part 13 of the flexible film is only very limited with this type of interrupter, it is advantageous to ensure that the control member 20 comprises a lip which has a reduced thickness at its periphery 23 and is flexible and can be deformed under the influence of pressure on the contact point 16*a*. It is then achieved that, the pin 21 being pushed against the inner edge of the truncated cone 28, the value of the pressure exerted by the lip of reduced thickness remains controllable and is not excessively high, notwithstanding the small variations of the dimensions due to the tolerances in the manufacture of the various elements.

It should be noted that the contact means described in this embodiment is not used specifically for the purpose of the invention and that any other interrupter actuated by pressure could be used in the same manner. There can be fixed on the lower part of the housing a given number of interrupters distributed along a circle, their number depending upon the number of directions that should be controlled.

Figure 3:
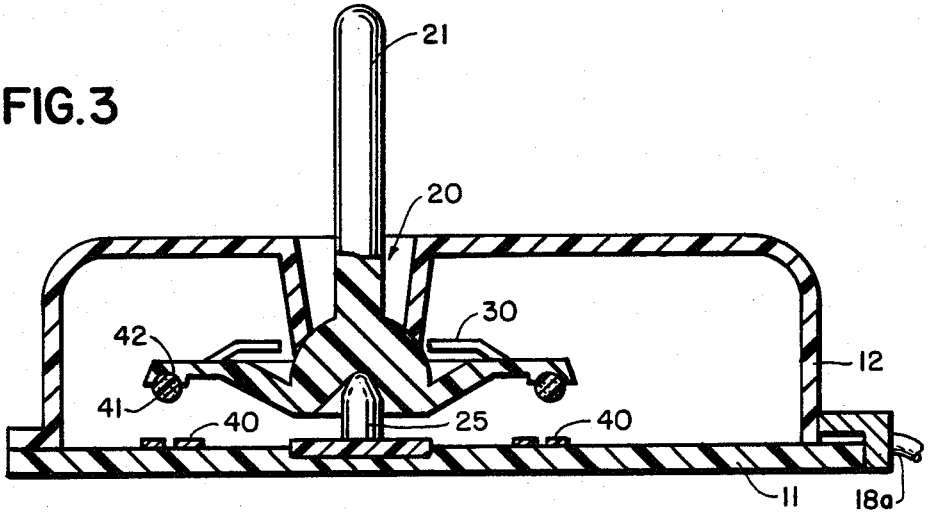
FIG. 3 is a sectional view of a device in an embodiment according to the invention.
Figure 4:
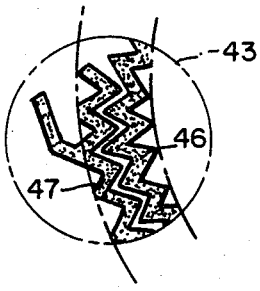
FIG. 4 is a partial plan view of conductor tracks in the device of FIG. 3.

FIG. 3 shows, therefore, an embodiment according to the invention, in which, by a modification of the contact means used, a high degree of simplicity of the assembly of the device is obtained. The equivalent parts of the arrangements of FIG. 3 and of FIGS. 1A and 1B are provided with the same reference numerals. The embodiment of FIG. 3 is distinguished by the fact that in this case the conductor tracks 40 are directly carried by the inner surface of the lower part 11 of the housing. As is well known in the art, other conductor tracks (not shown) carried by the part 11 can suitably electrically connect the tracks 40 to conductors of a cable 18*a*. For the part 11 of the housing, a polymeric material having good dielectric properties is used, on which all of the conductor tracks can be formed by applying a conductive paste by a silk screen process. The fact that the finger 25 is separately formed on the lower part 11 and is not obtained simultaneously with the latter by molding can simplify the relevant silk screen process. The control member 20 carries on its peripheral crown a ring 41 of a conducting elastomer separately formed and fixed, for example, in a recess 42 of the periphery. A part of the conductor tracks 40 carried by the lower part 11 is indicated in a partial plan view by the part 43 of the FIG. 4 enclosed by a dot-and-dash line. In this case, the conductor track 46 is the "common" conductor, while the conductor track 47 is localized on a sector corresponding to a given direction. In order to promote the establishment of the electrical connection between the conductor tracks 46 and 47 determined by local pressure on the ring 41, the tracks are arranged in zigzag fashion so that the shunt effect is multiplied during the contact with the ring 41. In a similar manner, it could be ensured that the conductor tracks 46 and 47 comprise radial parts in the form of the teeth of two combs which are interdigitated but insulated from each other, especially at the points provided for the contacts.

With respect to the embodiments described, those skilled in the art can readily provide other variants without departing from the scope of the invention. Especially, the contact means, which has been described as being fixed to the lower part of the housing, could be fixed in a similar manner below the upper part. Small geometric modifications have to be provided in the system so that it can operate in this case; these modifications can be found readily.

As to the materials that can be used for the housing, materials are to be preferred which are shaped by molding. It goes without saying that besides requirements with respect to electrical insulation, there is a considerable choice in determining the materials for use in the construction of the device according to the invention, except for the control member which requires the use of a material which is elastically deformable and substantially does not flow.

What is claimed is:

1. A multi-part interrupter device, comprising:

a housing (10) which includes a first part (11) connected to a second part (12);

a plurality of contact means for acting as an electrical interrupter, distributed along a circle and joined to the first part of the housing;

a control member (20) formed of a single piece of resilient material, the control member and the plurality of contact means being accommodated between the first and the second parts of the housing, the control member including:

a control lever integral therewith, the control lever having, at one end, a pin (21) emerging from the housing through an opening of the second part of the housing (12), the other end of the control lever being supported by a central pivot (25) carried by the first part of the housing, so that the control lever can be inclined in different directions from a central rest position, resilient return means for biasing the control member, the resilient return means including parts integrally formed with the control member, the parts being elastically deformable and arranged so that the parts bear on abutment means carried by the second part of the housing, whereby the resilient return means biases the control member to the central rest position, and a peripheral crown (23) arranged to act on at least one of the contact means when the control lever is manually inclined;

characterized in that the parts of the control member (20) constituting the resilient return means include a plurality of tongues (30) radially cut from a disc-shaped part (22) of the control member, the disc-shaped part connecting the control lever to the peripheral crown (23), the flexible ends of the plurality of tongues facing the center of the disc-shaped part (22), and the opening of the second part of the housing being formed by a truncated cone (28) extending into the interior of the housing and having an axis which substantially coincides with the axis of the central pivot, the abutment means including a lateral outer surface of the truncated cone.

2. A device as claimed in claim 1, characterized in that the first part of the housing being formed of an insulating material and having an inner surface facing the interior of the housing, the plurality of contact means including an assembly of conductor tracks insulated from each other and carried on the inner surface, the plurality of contact means also including the peripheral crown being provided with a ring formed of a conductive elastomer for establishing an electrical connection between at least two of the conductor tracks.

* * * * *